US009862590B2

(12) United States Patent
Chung

(10) Patent No.: US 9,862,590 B2
(45) Date of Patent: Jan. 9, 2018

(54) ELECTRIC DECANTER

(71) Applicant: MERCURIES ASIA LTD., Taipei (TW)

(72) Inventor: Yeh-Yi Chung, Taipei (TW)

(73) Assignee: MERCURIES ASIA LTD., Taipei (TW)

( * ) Notice: Subject to any disclaimer, the term of this patent is extended or adjusted under 35 U.S.C. 154(b) by 0 days.

(21) Appl. No.: 15/171,571

(22) Filed: Jun. 2, 2016

(65) Prior Publication Data

US 2016/0354733 A1 Dec. 8, 2016

(30) Foreign Application Priority Data

Jun. 5, 2015 (TW) ..... 104209045 U

(51) Int. Cl.

| | |
|---|---|
| ***B01F 3/04*** | (2006.01) |
| ***B67D 1/10*** | (2006.01) |
| ***B01F 5/04*** | (2006.01) |
| ***B01F 13/00*** | (2006.01) |
| ***B01F 15/00*** | (2006.01) |
| *B67D 1/00* | (2006.01) |

(52) U.S. Cl.

CPC ..... *B67D 1/10* (2013.01); *B01F 3/04787* (2013.01); *B01F 5/0428* (2013.01); *B01F 13/002* (2013.01); *B01F 15/00519* (2013.01); *B01F 2005/044* (2013.01); *B01F 2215/007* (2013.01); *B01F 2215/0072* (2013.01); *B67D 1/0004* (2013.01); *B67D 2001/0088* (2013.01)

(58) Field of Classification Search

CPC .. B67D 1/10; B01F 3/04787; B01F 15/00519; B01F 13/002; B01F 2005/044; B01F 2215/0072

See application file for complete search history.

(56) References Cited

U.S. PATENT DOCUMENTS

| | | | | |
|---|---|---|---|---|
| 6,508,163 | B1 * | 1/2003 | Weatherill | A47G 23/00 261/112.1 |
| 8,561,970 | B1 * | 10/2013 | Mills | B01F 13/002 261/124 |
| 2013/0270722 | A1 * | 10/2013 | Phillips | B01F 3/04808 261/64.3 |
| 2014/0242241 | A1 * | 8/2014 | Chen | B67D 1/0085 426/474 |
| 2015/0367295 | A1 * | 12/2015 | Okumura | B01F 13/002 99/323.1 |

* cited by examiner

*Primary Examiner* — Donnell Long
(74) *Attorney, Agent, or Firm* — patenttm.us

(57) ABSTRACT

A liquid drawing device includes a main body assembly, a drawing pump mounted inside the main body assembly; an adjustable air intake is mounted outside the air intake hole of the connecting seat of the main body assembly, and the first liquid delivery pipe of the connecting seat is mounted with a drawing straw. With the drawing pump drawing liquid inside a container, the procedure of liquid drawing may not be restricted by whether an airtight condition of an opening of the container is well maintained, and an opened degree of the air intake hole of the connecting seat can be adjusted by the adjustable air intake. Besides, because the drawing straw is a telescopic pipe assembly with a plurality of sections, the liquid drawing device can be conveniently carried around after the drawing straw is retracted and shortened.

5 Claims, 9 Drawing Sheets

ELECTRIC DECANTER

BACKGROUND OF THE INVENTION

1. Field of the Invention

The present invention relates to a liquid drawing device, especially to a drawing device which draws liquid by a pump and can adjust air concentration of the liquid.

2. Description of the Prior Arts

A liquid drawing device is a device for drawing a beverage in a container, and is capable of mixing the environmental air into the beverage during the drawing. A common process is applied to wine, mixing air to the wine for decanting during the drawing of the wine. When applied to drawing mineral water, the liquid drawing device can increase an oxygen content of the mineral water drawn from the bottle. Thus, the liquid drawing device can improve the flavor of the beverage.

A conventional liquid drawing device, as disclosed in Taiwan Patent NO. 1339704, compresses the environmental air into a container by operating an air pump, and the compressed air presses a surface of liquid inside the container, which has an opening maintained at a good airtight condition, so that the liquid is pressed into an insert pipe of the casing and then is guided to an outlet pipe and flows out of the container. Meanwhile, during the procedure of the liquid flowing through the insert pipe, another compressed air is mixed with the flowing liquid via a vent of the insert pipe and thereby the purpose of decanting is achieved.

However, the airtight condition between a compressing device and an opening of the container should be well maintained during an operating process of the conventional liquid drawing device, or an efficacy of transporting environmental air into the container and compressing the air will be decreased because the airtight condition is not maintained well. Besides, a vent of the conventional liquid drawing device has regular dimensions so that the user can control the size of the vent according to a type of the beverage. For instance, when the drawn beverage is white wine, which does not have to undergo a decanting step, the vent should be closed. In addition, a drawing straw is a regular-length pipe. Because the drawing straw cannot be shortened, the user will encounter problems when carrying the whole liquid drawing device.

SUMMARY OF THE INVENTION

The purpose of the invention is to obviate the shortcomings of the conventional device that a liquid drawing process is restricted by whether the airtight condition is well maintained, dimensions of a vent are not adjustable, and a drawing straw cannot be shortened, which is inconvenient, and a user will encounter problems carrying the device around. By practicing the technical means of the present invention, an opened degree of the air intake hole can be controlled according to usage demand, a liquid drawing process may not be restricted by an airtight condition of an opening of a bottle, and a drawing straw can be retracted and shortened according to conditions for ease of carrying.

In order to achieve the aforesaid purpose, the invention adopts a technical means which provides a liquid drawing device comprising a main body assembly, a drawing pump, a connecting seat, an adjustable air intake, and a drawing straw;

the main body assembly being a sealing shell with a power supply therein, the main body assembly including a second liquid delivery pipe, and a through hole;

the connecting seat mounted inside the main body assembly and including a first accommodating recess, a first liquid delivery pipe, an air intake hole, a first conveying passage, and a second conveying passage;

the first accommodating recess concaved on one end surface of the connecting seat, the first liquid delivery pipe protruding on another end surface of the connecting seat, the air intake hole formed through a side wall of the connecting seat and communicating with the first liquid delivery pipe, the first conveying passage formed through a bottom surface of the first accommodating recess and communicating with the air intake hole, and one end of the second conveying passage formed on and communicating with the bottom surface of the first accommodating recess, and another end of the second conveying passage formed on the side wall of the connecting seat; the first liquid delivery pipe mounted through the through hole of the main body assembly, the second liquid delivery pipe corresponding to and connected to the second conveying passage;

the drawing pump mounted inside the connecting seat and comprising an inlet end and an outlet end mounted on an end surface of the drawing pump, the inlet end and the outlet end connected to the first conveying passage and the second conveying passage respectively; the drawing pump electrically connected to the main body assembly;

the adjustable air intake connected to an outer wall of the connecting seat and corresponding to the air intake hole of the connecting seat; the adjustable air intake mounted inside the main body assembly;

the drawing straw being a telescopic pipe assembly with a plurality of sections, the drawing straw mounted on the first liquid delivery pipe of the connecting seat.

The liquid drawing device, wherein the main body assembly comprises a cover, a power assembly, and a casing;

the cover being a hollow object and comprising an installing hole formed through a top surface of the cover;

the power assembly comprising a switch button, a linkage seat, and a plurality of batteries:

the batteries mounted on the linkage seat, the linkage seat electrically connected to the switch button and mounted inside the cover, and the switch button mounted in the installing hole of the cover, wherein the drawing pump is electrically connected to the power assembly;

the casing being a hollow object and comprising:

a second accommodating recess concaved at an end of the casing; the through hole formed in a bottom wall of the second accommodating recess and communicating with the second accommodating recess, the second liquid delivery pipe mounted through a side wall of the casing and communicating with the second accommodating recess, said end of the casing forming the second accommodating recess connected to the cover; the connecting seat mounted inside the second accommodating recess of the casing.

The liquid drawing device, wherein
the adjustable air intake comprises a valve seat, a valve rod, a knob, and a sealing ring:
the valve seat forming
an internal thread on an inner wall of the valve seat, and
an air inlet gap on an outer wall of the valve seat, the air inlet gap communicating to an inside of the valve seat;
the valve rod forming
an external thread on an outer wall of the valve rod, and
a taper portion and an installing column respectively on two ends of the valve rod;
the sealing ring mounted around the valve rod;
the knob mounted on the installing column, the taper portion of the valve rod accommodated inside the valve seat and screwed with the valve seat;
the casing further comprises
an assembling seat protruding from an outer wall of the casing, shaped into a hollow extending column, and comprising
a covering sheet forming a hole in a center thereof, wherein
an inside of the assembling seat communicates to an inside of the casing, the air intake hole of the connecting seat corresponding to the assembling seat;
wherein the valve seat is mounted on an outer wall of the connecting seat and corresponding to the air intake hole, and the air inlet gap and the outer wall of the connecting seat forming
an air inlet passage, the taper portion of the valve rod selectively abutting the air intake hole;
the valve seat accommodated inside the assembling seat of the casing; and said end of the valve rod forming the installing column mounted through the through hole of the covering sheet.
The liquid drawing device, further comprising:
an assembling sleeve;
wherein the connecting seat further comprises
an assembling portion protruding from said another end surface of the connecting seat and covering an outer edge of the first liquid delivery pipe;
the assembling sleeve being a socket and mounted around an outer wall of the assembling portion of the connecting seat, one end of the assembling sleeve being an open end, another end of the assembling sleeve being a closed end, the open end of the assembling sleeve abutted on a bottom end of the main body assembly, the closed end of the assembling sleeve forming
an assembling hole, the first liquid delivery pipe mounted through and out of the assembling hole.
The liquid drawing device, wherein
the connecting seat further comprises
two combining seats protruding from the outer wall of the connecting seat and corresponding to each other;
the drawing pump further comprises
two combining portions formed on the outer wall of the drawing pump and corresponding to each other; the two combining portions connected to the two combining seats of the connecting seat respectively.

The advantages of the invention is that: with the drawing pump mounted inside the connecting seat, liquid in the container can be drawn to the drawing pump through the drawing straw, and then the liquid is discharged by the second liquid delivery pipe of the casing, and the liquid in the container is directly drawn by the drawing pump so that a liquid drawing process may not be restricted by whether an airtight condition between the assembling sleeve and an opening of the container is well maintained; as an opened degree of the air intake hole of the connecting seat can be controlled by the adjustable air intake, the user can fully open, partially open, or close the air intake hole in accordance with a type of the liquid in the container; and as the drawing straw is a telescopic pipe assembly with a plurality of sections, when it is necessary to carry the liquid drawing device around, the user can retract and shorten the drawing straw for ease of carrying.

DETAILED DESCRIPTION OF THE PREFERRED EMBODIMENTS

The following figures and preferred embodiments further describe the technical means adopted by the present invention to achieve the aforementioned objectives.

Figure 1:
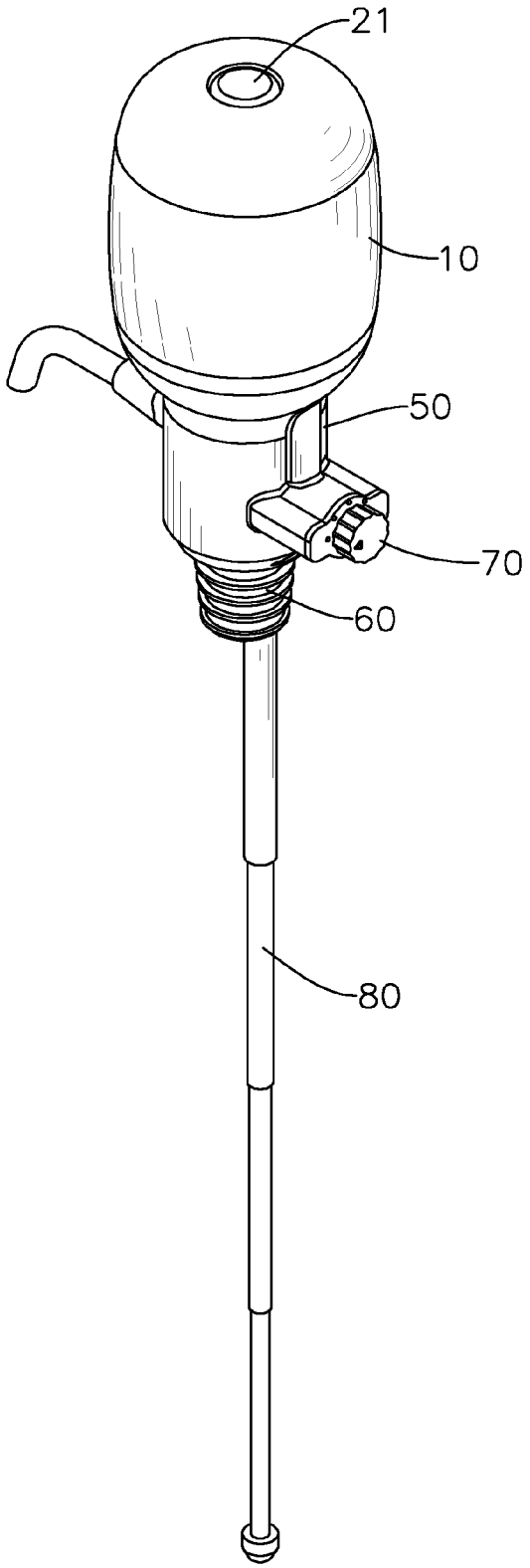
FIG. 1 is an exterior perspective view of the present invention.
Figure 2:
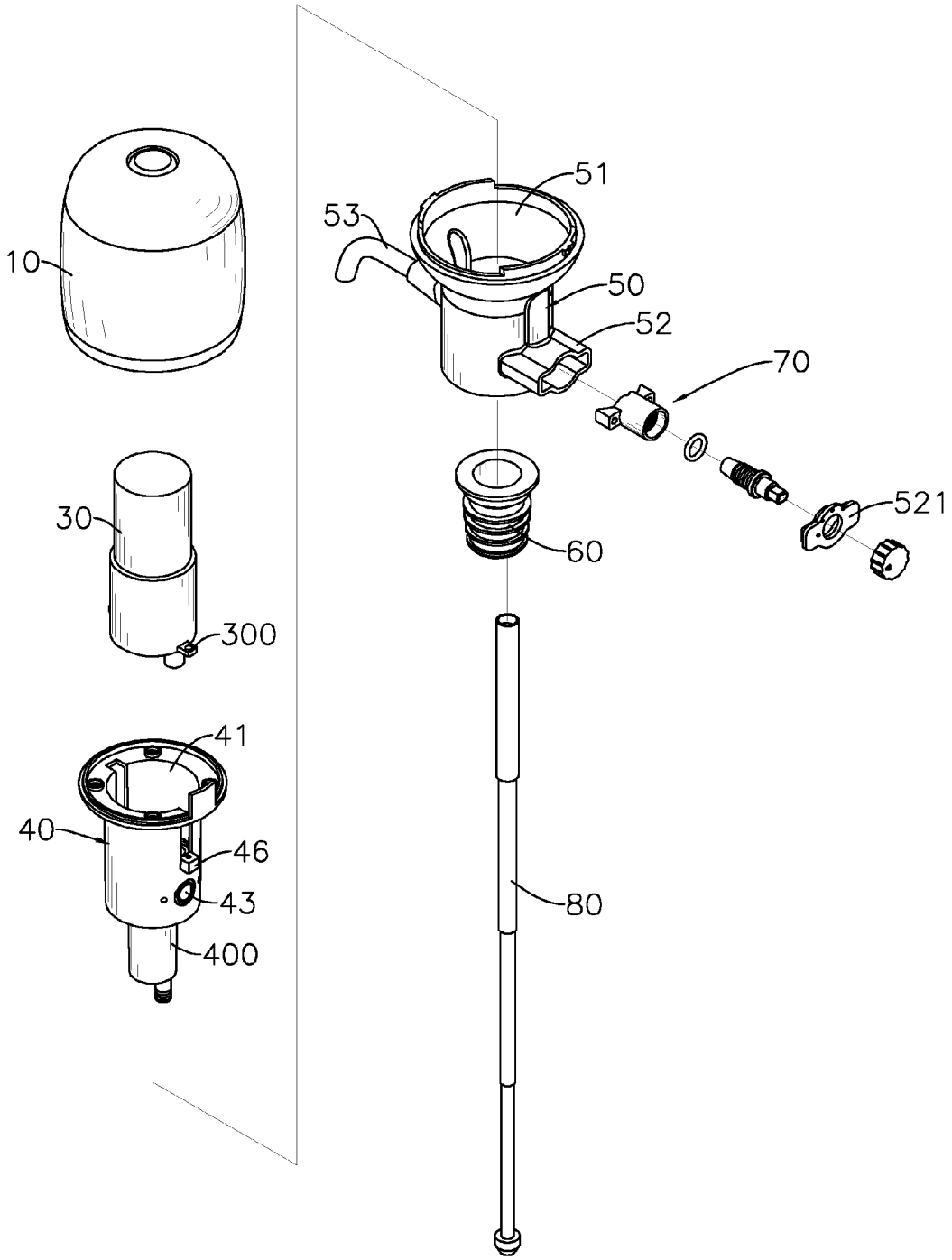
FIG. 2 is an exploded perspective view of the present invention.

Please refer to FIGS. 1 and 2. The liquid drawing device of the invention is provided with a main body assembly, a drawing pump 30, a connecting seat 40, an adjustable air intake 70, and a drawing straw 80.

Figure 3:
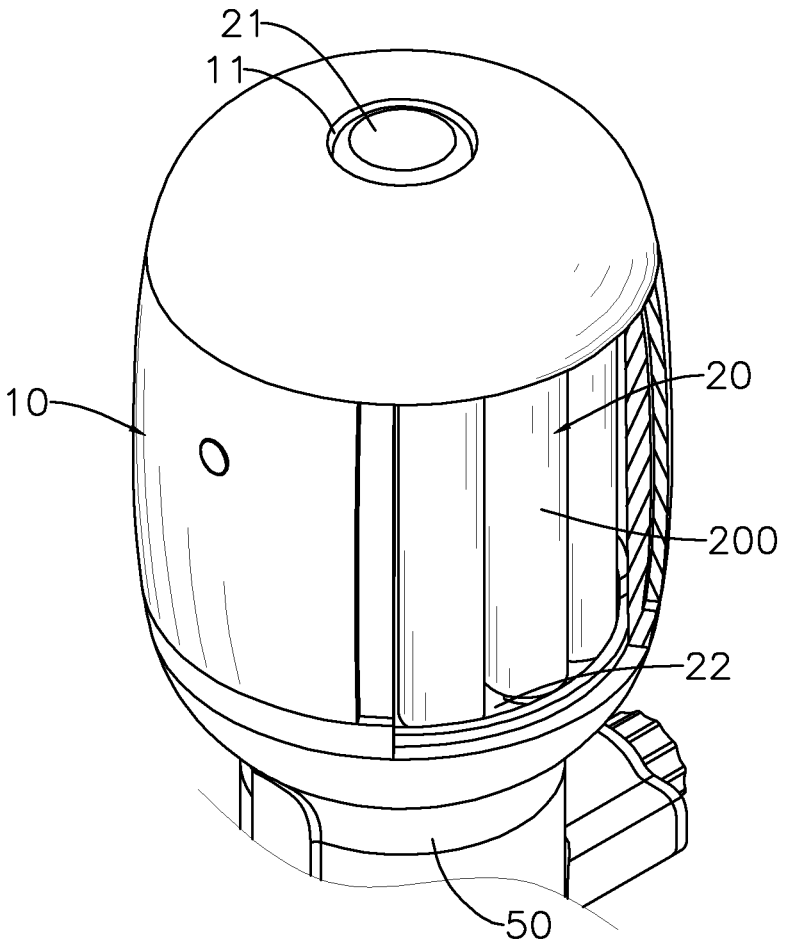
FIG. 3 is a partial perspective view of the cover of the present invention.

Please refer to FIG. 3. The main body assembly is a sealing shell with a power supply therein and includes a cover 10, a power assembly 20, and a casing 50.

The cover 10 is a hollow object and comprises an installing hole 11. The installing hole 11 is formed through a top surface of the cover 10.

The power assembly 20 comprises a switch button 21, a linkage seat 22, and a plurality of batteries 200. The batteries 200 are mounted on the linkage seat 22 and the linkage seat 22 is electrically connected to the switch button 21. The linkage seat 22 is mounted inside the cover 10, and the switch button 21 is mounted in the installing hole 11 of the cover 10 so that the user can turn on the invention by pressing the switch button 21.

Figure 6:
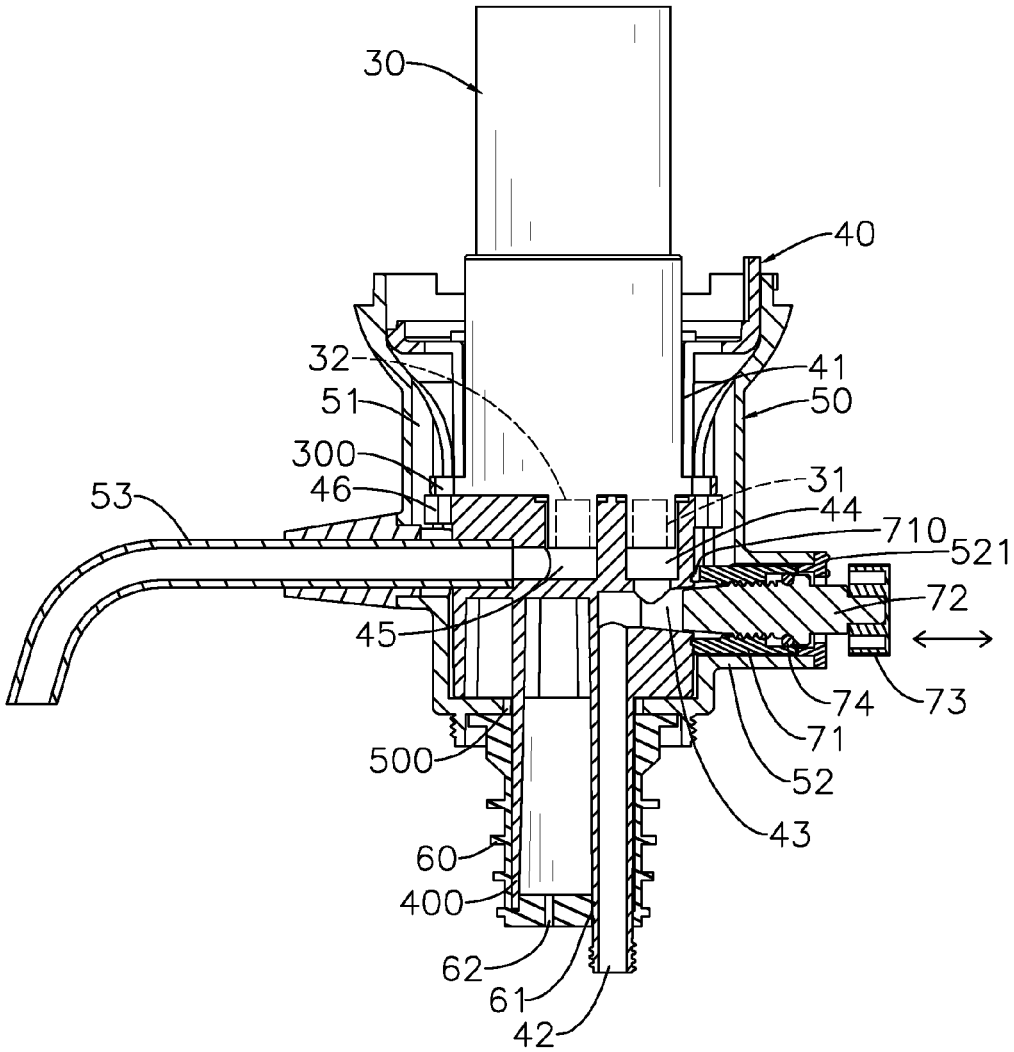
FIG. 6 is a side cross-sectional view of the present invention.
Figure 8:
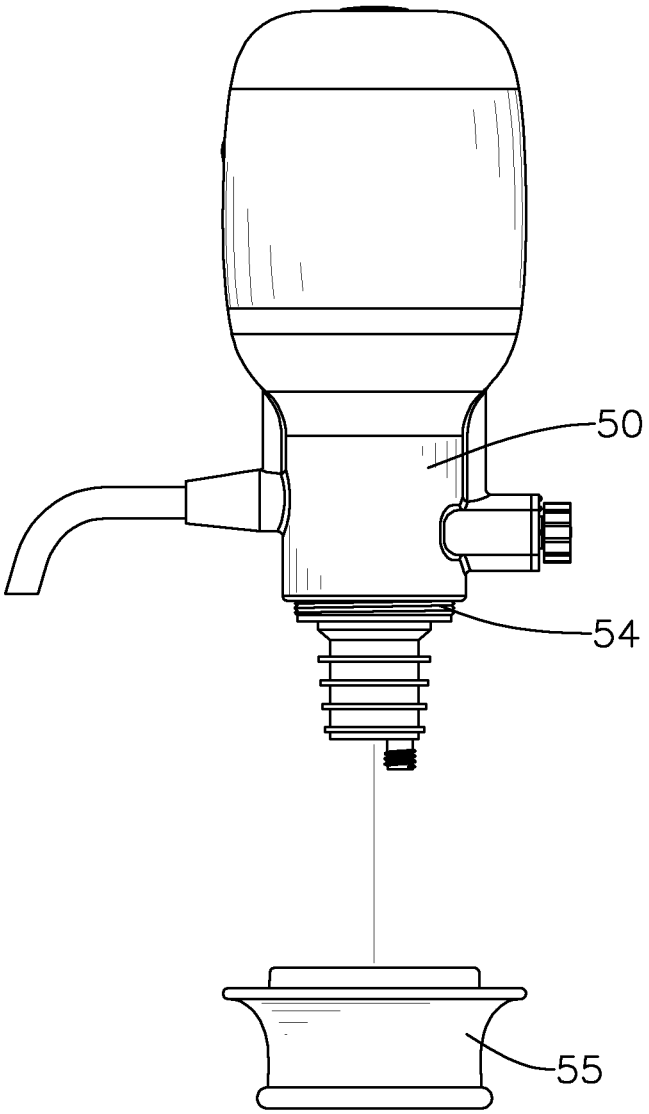
FIG. 8 is a plane exploded view of the casing and a collar of the present invention.

Please refer to FIGS. 2, 6, and 8. The casing 50 is a hollow object and comprises a second accommodating recess 51, an assembling seat 52, a second liquid delivery pipe 53, and a through hole 500. The second accommodating recess 51 is concaved at one end of the casing 50, and the through hole 500 is formed in a bottom wall of the second accommodating recess 51 and communicates with the second accommodating recess 51. The assembling seat 52 protrudes from an outer wall of the casing 50, and the assembling seat 52 is shaped into a hollow extending column and comprises a covering sheet 521. The covering sheet 521 forms a hole in a center thereof. An inside of the assembling seat 52 communicates to the second accommodating recess 51. The second liquid delivery pipe 53 is mounted through a side wall of the casing 50 and communicates to the second accommodating recess 51. More precisely, the casing 50 further comprises a collar 55. The collar 55 is a ring which forms a hole in a center thereof, and an inner wall of one end of the hole forms an internal thread. In addition, a connecting portion 54 protrudes on the other end of the casing 50, an outer wall of the connecting portion 54 forms an external thread, and the collar 55 is screwed on the connecting portion 54. Said end of the casing 50 that forms the second accommodating recess 51 is connected to the cover 10.

Figure 4:
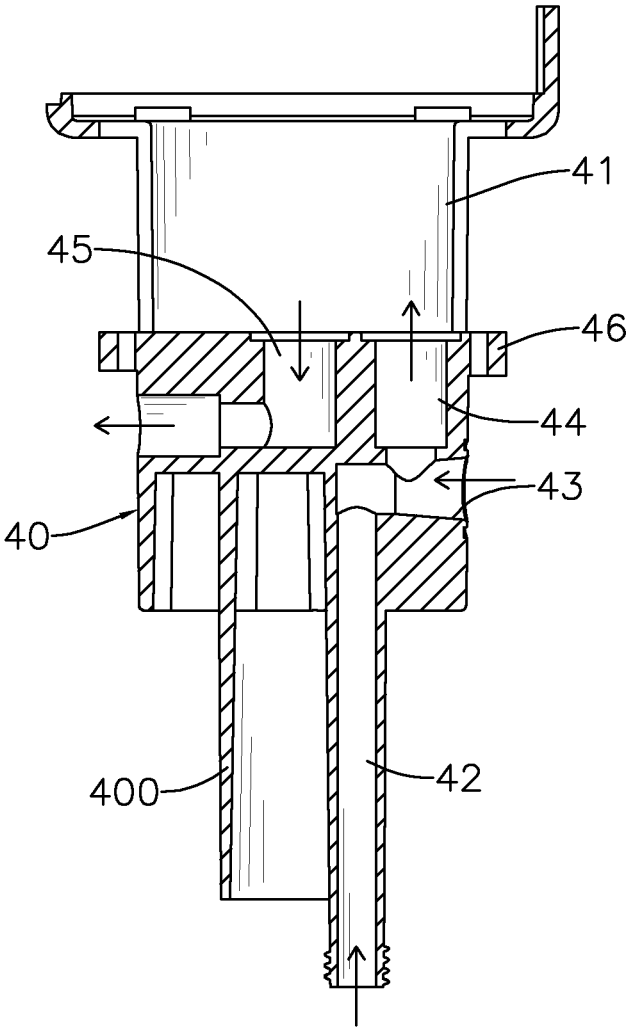
FIG. 4 is a side cross-sectional view of the connecting seat of the present invention.
Figure 7:
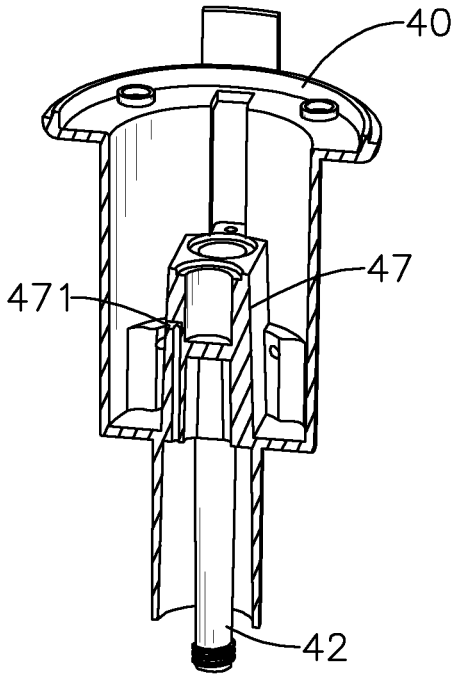
FIG. 7 is a sectional perspective view of the connecting seat of the present invention.

Please refer to FIGS. 4, 6 and 7. The connecting seat 40 is mounted inside the main body assembly, and comprises a first accommodating recess 41, a first liquid delivery pipe 42, an air intake hole 43, a first conveying passage 44, a second conveying passage 45, two combining seats 46, and an assembling portion 400. The first accommodating recess 41 is on one end surface of the connecting seat 40. The first liquid delivery pipe 42 and the assembling portion 400 protrude on another end surface of the connecting seat 40, and the assembling portion 400 covers an outer edge of the first liquid delivery pipe 42. The air intake hole 43 is formed through the side wall of the connecting seat 40 and communicates with the first liquid delivery pipe 42. The first conveying passage 44 is formed through a bottom surface of the first accommodating recess 41 and communicates with the air intake hole 43. One end of the second conveying passage 45 is formed on and communicates with the bottom surface of the first accommodating recess 41, and the other end of the second conveying passage 45 is formed on the side wall of the connecting seat 40. The two combining seats 46 protrude from an outer wall of the connecting seat 40 and correspond to each other. More precisely, a protruding seat 47 is formed on an inner bottom surface of the first accommodating recess 41, and a first vent 471 extending in an L shape is formed through the protruding seat 47. The connecting seat 40 is mounted inside the second accommodating recess 51 of the casing 50, the first liquid delivery pipe 42 and the assembling portion 400 are mounted through the through hole 500, the air intake hole 43 corresponds to the assembling seat 52, and the second liquid delivery pipe 53 corresponds to and is connected to the second conveying passage 45.

Please refer to FIGS. 2 and 6. The drawing pump 30 is mounted inside the connecting seat 40 and comprises two combining portions 300, an inlet end 31, and an outlet end 32. The inlet end 31 and the outlet end 32 are mounted on an end surface of the drawing pump 30, and the two combining portions 300 are formed on an outer wall of the drawing pump 30 and correspond to each other. The two combining portions 300 are connected to the two combining seats 46 of the connecting seat 40 respectively. The inlet end 31 and the outlet end 32 are connected to the first conveying passage 44 and the second conveying passage 45 respectively. The drawing pump 30 is electrically connected to the power assembly 20. The drawing pump 30 is a conventional device, so detailed descriptions thereof would be omitted.

Figure 5:
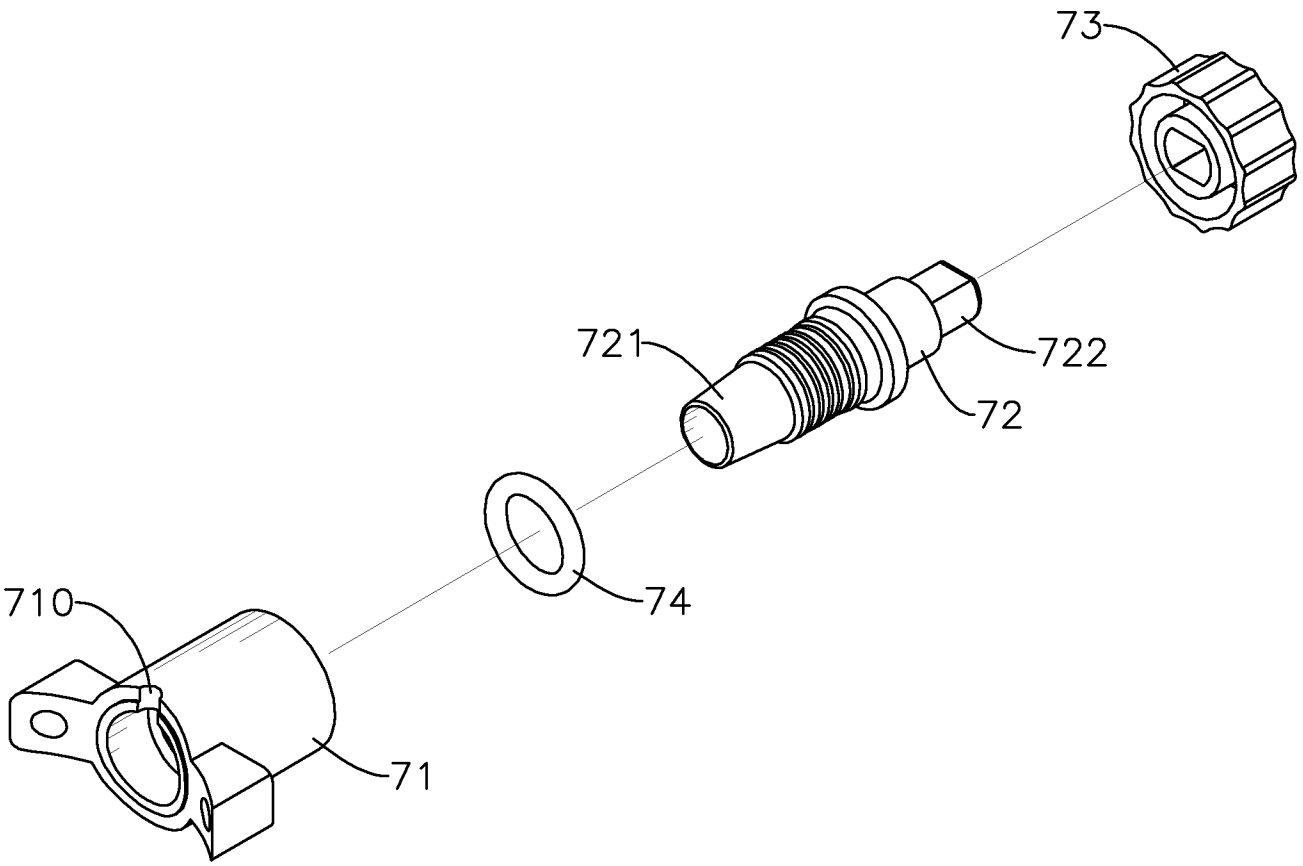
FIG. 5 is an exploded perspective view of the adjustable air intake of the present invention.

Please refer to FIGS. 5 and 6. The adjustable air intake 70 is connected to the outer wall of the connecting seat 40 and corresponds to the air intake hole 43. The adjustable air intake 70 is mounted inside the main body assembly and comprises a valve seat 71, a valve rod 72, a knob 73, and a sealing ring 74. An internal thread is formed on an inner wall of the valve seat 71, and an air inlet gap 710 is formed on an outer wall of the valve seat 71. The air inlet gap 710 communicates to an inside of the valve seat 71. An external thread is formed on an outer wall of the valve rod 72, and the sealing ring 74 is mounted around the valve rod 72. Two ends of the valve rod 72 form a taper portion 721 and an installing column 722 respectively. The knob 73 is mounted on the installing column 722, and the taper portion 721 of the valve rod 72 is accommodated in and screwed with the valve seat 71. The valve seat 71 is mounted on the outer wall of the connecting seat 40 and corresponds to the air intake hole 43. The air inlet gap 710 and the outer wall of the connecting seat 40 form an air inlet passage. The taper portion 721 of the valve rod 72 selectively abuts on the air intake hole 43. The valve seat 71 is mounted inside the assembling seat 52 of the casing 50. Said end of the valve rod 72 forming the installing column 722 is mounted through the hole of the covering sheet 521.

The drawing straw 80 is a telescopic pipe assembly with a plurality of sections, and is mounted on the first liquid delivery pipe 42 of the connecting seat 40.

The invention further comprises an assembling sleeve 60. The assembling sleeve 60 is a socket, one end of the socket is an open end, and the other end of the socket is a closed end. An assembling hole 61 and a second vent 62 are formed through the closed end of the assembling sleeve 60. The assembling sleeve 60 is mounted around an outer wall of the assembling portion 400 of the connecting seat 40. The open end of the assembling sleeve 60 abuts on the bottom end of the casing 50. The first liquid delivery pipe 42 is mounted through and out of the assembling hole 61. The second vent 62 can communicate with the first vent 471 of the protruding seat 47.

Figure 9:
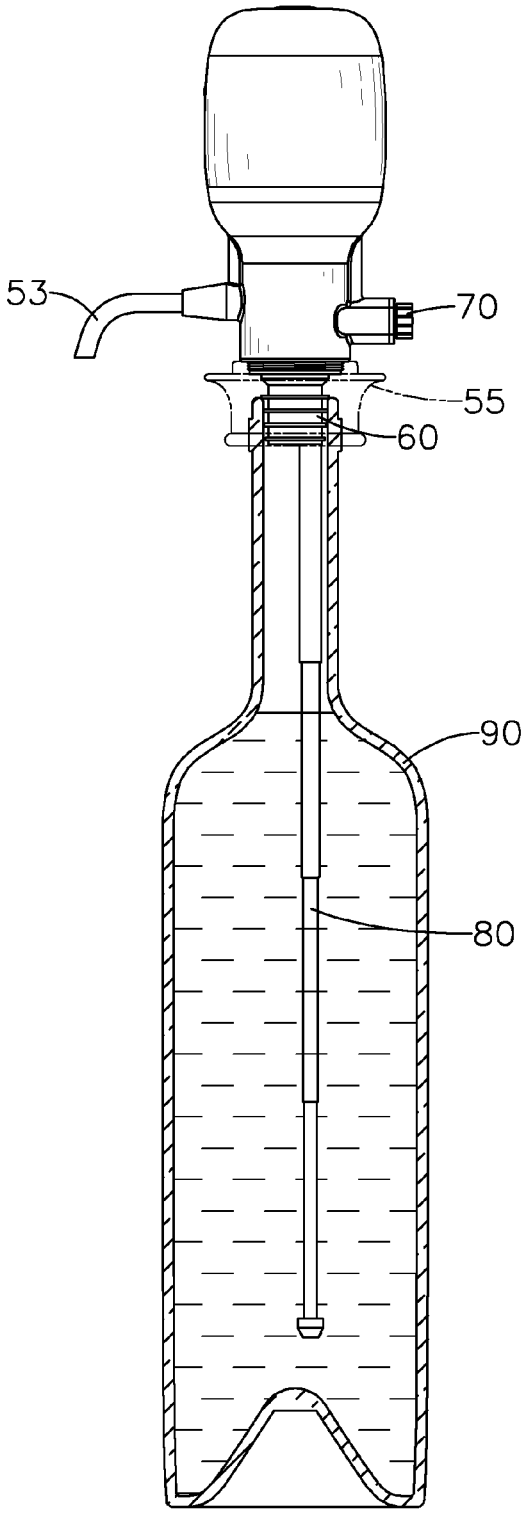
FIG. 9 is a front schematic view of the present invention.

Please refer to FIG. 9. With the assembling sleeve 60 mounted in an opening of a container 90 and the drawing straw 80 extending into liquid in the container 90, the invention allows the user to control the adjustable air intake 70 according to a type of the liquid inside the container 90. In addition, with the collar 55 of the casing 50, the collar 55 can cover the opening of the container 90, which makes an outward appearance of the container 90 more elegant and visually appealing when mounted with the present invention.

When the user presses the switch button 21 to turn on the drawing pump 30, the liquid in the container 90 sequentially passes through the drawing straw 80, the first liquid delivery pipe 42, the first conveying passage 44, and the inlet end 31, and then is drawn to the drawing pump 30. After that, the drawn liquid is conveyed out through the outlet end 32, the second conveying passage 45, and the second liquid delivery pipe 53.

When the liquid in the container 90 is wine or whiskey, the user can turn the knob 73, making the valve rod 72 move back with respect to the valve seat 71 so that the taper portion 721 moves away from the air intake hole 43. Thus, air is mixed with the drawn wine or whiskey at the air inlet gap 710 and the wine undergoes a decanting step during the conveying process. If the liquid in the container 90 is mineral water, the user can adjust the knob 73 and keep the taper portion 721 and the air intake hole 43 separate from each other, which cause an opened degree of the air intake hole 43 to be smaller, but air still can be mixed to the drawn mineral water at the air inlet gap 710 so that the user can taste the mineral water with more dissolved oxygen. If the liquid in the container 90 is white wine, the user can control the knob and make the taper portion 721 abut the air intake hole 43, causing the air intake hole 43 to close so that the present invention simply draws the liquid in the container 90 because white wine does not need decanting. Along with drawing out of the liquid in the container 90 by the present invention, environmental air enters the container 90 through the first vent 471 of the protruding seat 47 of the connecting seat 40 and the second vent 62 of the assembling sleeve 60, and pressure difference between an inside and an outside the container 90 can be balanced to prevent the inside of container 90 becoming a vacuum, which obstructs the liquid drawing process.

With the drawing pump 30 mounted inside the connecting seat 40, the present invention makes the liquid in the container 90 drawn to the drawing pump 30 through the drawing straw 80, and then discharged from the second liquid delivery pipe 53 of the casing 50 mounted inside the connecting seat 40. Because the liquid in the container 90 is drawn directly by the drawing pump 30, the liquid drawing process may not be restricted by whether the airtight condition between the assembling sleeve 60 and the container 90 is well maintained. As the opened degree of the air intake hole 43 of the connecting seat 40 can be adjusted by the adjustable air intake 70, the user can fully open, partially open, or close the air intake hole in accordance with a type of the liquid in the container 90. In addition, because the drawing straw is a telescopic pipe assembly with a plurality of sections, when it is necessary to bring the liquid drawing device around, the user can retract and shorten the drawing straw for ease in carrying.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

The invention claimed is:

1. A liquid drawing device comprising a main body assembly, a drawing pump, a connecting seat, an adjustable air intake, and a drawing straw:

the main body assembly being a sealing shell with a power supply therein, the main body assembly including a second liquid delivery pipe, and a through hole;

the connecting seat mounted inside the main body assembly and including a first accommodating recess, a first liquid delivery pipe, an air intake hole, a first conveying passage, and a second conveying passage;

the first accommodating recess concaved on one end surface of the connecting seat, the first liquid delivery pipe protruding on another end surface of the connecting seat, the air intake hole formed through a side wall of the connecting seat and communicating with the first liquid delivery pipe, the first conveying passage formed through a bottom surface of the first accommodating recess and communicating with the air intake hole, and one end of the second conveying passage formed on and communicating with the bottom surface of the first accommodating recess, and another end of the second conveying passage formed on the side wall of the connecting seat; the first liquid delivery pipe mounted through the through hole of the main body assembly, the second liquid delivery pipe corresponding to and connected to the second conveying passage;

the drawing pump mounted inside the connecting seat and comprising an inlet end and an outlet end mounted on an end surface of the drawing pump, the inlet end and the outlet end connected to the first conveying passage and the second conveying passage respectively; the drawing pump electrically connected to the main body assembly;

the adjustable air intake connected to an outer wall of the connecting seat and corresponding to the air intake hole of the connecting seat; the adjustable air intake mounted inside the main body assembly;

the drawing straw being a telescopic pipe assembly with a plurality of sections, the drawing straw mounted on the first liquid delivery pipe of the connecting seat.

2. The liquid drawing device as claimed in claim 1, wherein the main body assembly comprises a cover, a power assembly, and a casing;

the cover being a hollow object and comprising an installing hole formed through a top surface of the cover;

the power assembly comprising a switch button, a linkage seat, and a plurality of batteries;

the batteries mounted on the linkage seat, the linkage seat electrically connected to the switch button and mounted inside the cover, and the switch button mounted in the installing hole of the cover, wherein the drawing pump is electrically connected to the power assembly;

the casing being a hollow object and comprising:

a second accommodating recess concaved at an end of the casing; the through hole formed in a bottom wall of the second accommodating recess and communicating with the second accommodating recess, the second liquid delivery pipe mounted through a side wall of the casing and communicating with the second accommodating recess, said end of the casing forming the second accommodating recess connected to the cover; the connecting seat mounted inside the second accommodating recess of the casing.

3. The liquid drawing device as claimed in claim 2, wherein the adjustable air intake comprises a valve seat, a valve rod, a knob, and a sealing ring:

the valve seat forming an internal thread on an inner wall of the valve seat, and an air inlet gap on an outer wall of the valve seat, the air inlet gap communicating to an inside of the valve seat;

the valve rod forming an external thread on an outer wall of the valve rod, and a taper portion and an installing column respectively on two ends of the valve rod;

the sealing ring mounted around the valve rod;

the knob mounted on the installing column, the taper portion of the valve rod accommodated inside the valve seat and screwed with the valve seat;

the casing further comprises an assembling seat protruding from an outer wall of the casing, shaped into a hollow extending column, and comprising a covering sheet forming a hole in a center thereof, wherein an inside of the assembling seat communicating to an inside of the casing, the air intake hole of the connecting seat corresponding to the assembling seat;

wherein the valve seat is mounted on the outer wall of the connecting seat and corresponding to the air intake hole, and the air inlet gap and the outer wall of the connecting seat forming an air inlet passage, the taper portion of the valve rod selectively abutting the air intake hole;

the valve seat accommodated inside the assembling seat of the casing; and said end of the valve rod forming the installing column mounted through the hole of the covering sheet.

4. The liquid drawing device as claimed in claim 3 further comprising:

an assembling sleeve;

wherein the connecting seat further comprises an assembling portion protruding from said another end surface of the connecting seat and covering an outer edge of the first liquid delivery pipe;

the assembling sleeve being a socket and mounted around an outer wall of the assembling portion of the connecting seat, one end of the assembling sleeve being an open end, another end of the assembling sleeve being a closed end, the open end of the assembling sleeve abutted on a bottom end of the main body assembly, the closed end of the assembling sleeve forming an assembling hole, the first liquid delivery pipe mounted through and out of the assembling hole.

5. The liquid drawing device as claimed in claim 4, wherein the connecting seat further comprises two combining seats protruding from the outer wall of the connecting seat and corresponding to each other;

the drawing pump further comprises two combining portions formed on an outer wall of the drawing pump and corresponding to each other; the two combining portions connected to the two combining seats of the connecting seat respectively.

* * * * *